US005350286A

United States Patent [19]

Kisi et al.

[11] Patent Number: 5,350,286

[45] Date of Patent: Sep. 27, 1994

[54] LIQUID INJECTION TYPE SCREW COMPRESSOR WITH LUBRICANT RELIEF CHAMBER

[75] Inventors: Takayuki Kisi, Ibaragi; Keisuke Kasahara, Tokyo, both of Japan

[73] Assignee: Kabushiki Kaisha Naekawa Seisakusho, Tokyo, Japan

[21] Appl. No.: 921,910

[22] Filed: Jul. 29, 1992

[30] Foreign Application Priority Data

Nov. 30, 1990 [JP] Japan ..... 2-130135

[51] Int. Cl.[5] ..... F04C 15/00

[52] U.S. Cl. ..... 418/150; 418/190; 418/201.3

[58] Field of Search ..... 418/190, 201.3, 150

[56] References Cited

U.S. PATENT DOCUMENTS 5,002,472 3/1991 Helliot et al. ..... 418/201.3

FOREIGN PATENT DOCUMENTS 53-39508 4/1978 Japan .

59-37290 2/1984 Japan .

62-8301 1/1987 Japan .

81590 4/1991 Japan ..... 418/201.3

320474 9/1918 Netherlands ..... 418/190

2811570 9/1979 Netherlands ..... 418/201.3

*Primary Examiner*—Richard A. Bertsch

*Assistant Examiner*—Roland McAndrews, Jr.

*Attorney, Agent, or Firm*—Thomas R. Morrison

[57] ABSTRACT

A screw compressor has a male rotor and female rotor rotatably engaging each other in a casing. The male rotor has a radius R and Z-number of helical convex teeth, each of which is chamfered on a leading edge of an end facing the discharge end of casing to allow lubricating liquid to escape from a space between rotor teeth during discharge stages of operation. This prevents drastic increases in pressure upon the bearings due to a liquid compression phenomenon. Thrust forces produced by the liquid against a flat chamfer surface prevent scoring of the edges of the rotors and thus permit designs with narrow gaps between the rotors and the casing to improve the efficiency of the compressor.

11 Claims, 9 Drawing Sheets

LIQUID INJECTION TYPE SCREW COMPRESSOR WITH LUBRICANT RELIEF CHAMBER

This application is a continuation of international application PCT/JP91/01637 filed Nov. 28, 1991 which has designated the United States.

BACKGROUND OF THE INVENTION

1. Field of the Invention

The present invention relates to a liquid injection type screw compressor, and more particularly, to a liquid injection type screw compressor having a male rotor shaped to reduce a liquid compression phenomena.

2. Description of the Prior Art

Referring to FIG. 11, a conventional liquid injection type screw compressor has a casing 12 that includes an intake port at a first end and a discharge port 11 at an opposing second end in the longitudinal direction. The first end serves as an intake end of the casing 12 and the second end serves as a discharge end of the casing 12. A male rotor 13 and a female rotor 14, both having helical teeth, are installed in casing 12 with their helical teeth in engagement during rotation of rotors 13 and 14. A rotor tooth space 15 exists between rotors 13 and 14.

In a screw compressor as described above, gas compression begins when an intake process introduces gas from the intake port of casing 12 into rotor tooth space 15. Compression reduces the volume of rotor tooth space 15 during rotation of rotors 13 and 14, thereby compressing the gas. The compressed gas is discharged through discharge port 11 of casing 12.

The discharge process calls for conveying compressed gas contained in rotor tooth space 15 to discharge port 11 from the time when rotor tooth space 15 couples with the discharge port 11 until the rotation of rotors 13 and 14 reduces the volume of rotor tooth space 15 to zero. The discharge process comprises three stages, shown in FIGS. 11 through 13, characterized by the form of a discharge path coupling rotor tooth space 15 to discharge port 11.

Referring to FIG. 11, in the first stage, the compressed gas is discharged in the directions of both a radius and an axis of rotor tooth space 15.

Referring to FIG. 12, in the second stage, the compressed gas is discharged only in the axial direction of rotor tooth space 15 because a tooth of male rotor 13 engages a tooth of female rotor 14, thereby sealing off the radial path of discharge. This stage of the discharge process is called the "semi-closed condition."

Referring to FIG. 13, in the third stage, there is no discharge path connecting rotor tooth space 15 to discharge port 11. This stage is known as the "completely closed condition."

The surface of each tooth of rotors 13 and 14 is thoroughly lubricated by a liquid, such as oil, injected into casing 12 in order to absorb heat generated during gas compression and to effect a seal between the rotors 13 and 14, and between the rotors 13 and 14 and the casing 12. The seal formed by the oil reduces leakage of compressed gas from the discharge port 11 to the intake port.

The conventional liquid injection type screw compressor described above has no path connecting rotor tooth space 15 to discharge port 11 during the third stage of the discharge process when the compressor is in the completely closed condition. While this condition exists, the volume of rotor tooth space 15 continues to decrease. Thus, the lubricating liquid is trapped in rotor tooth space 15 and has pressure applied upon it by the rotors 13 and 14, causing a sudden radical increase of pressure upon the rotors. This increase in pressure is generally called a "liquid compression phenomenon."

The pressure increase caused by this liquid compression phenomenon imposes a pulsed load upon the rotors 13 and 14 and their respective bearings. This pulsed load reduces the life span of the bearings and creates undesirable vibration when the compressor is in operation.

Additionally, as the rotation speed of rotors 13 and 14 is increased, the flow resistance of the liquid against the surface of the teeth also increases. Thus, a form of the liquid compression phenomenon also occurs during the second stage of the discharge process, when the path is only partly closed and a semi-closed condition exists. Especially in cases where the compressed gas consists of light gas, such as hydrogen gas and helium gas, liquid tends to be trapped in the rotor tooth space 15 during the discharge process when the path is half or completely closed.

In order to reduce the above liquid compression phenomenon, various modifications are made to the shape of discharge port 11 of casing 12 as well as to the shape of the ends of rotors 13 and 14 facing discharge port 11. However, none of these modifications are sufficiently effective, each suffering from various drawbacks. The various drawbacks include a considerable quantity of leakage of compressed gas from the discharge port 11 to the intake port, and a resultant substantial decrease of compression efficiency.

Referring to FIG. 14, a rotor is shown that is modified so as to prevent the occurrence of the liquid compression phenomenon. A recess 16 on the discharge end of male rotor 13 is made by forming a step on the surface of each rotor tooth. Recess 16 is formed by cutting the discharge end of male rotor 13. This structure, however, requires the initiation of the pressure relieving of the liquid and gas even before the liquid compression phenomenon occurs in order to effect a complete elimination of the liquid compression phenomenon. Thus, this structure reduces the compression efficiency of the unit.

The male rotor 13 in FIG. 14, viewed without the obstruction of the female rotor 14, has a stepped recess formed by two slanted planes 18 and 19, cut into the discharge end of the rotor. Plane 18 runs parallel to the rotor axis and plane 19 runs such that its projection intersects the rotor axis. To prevent a run-off from being formed before an initiation of closing it is necessary to position the recess inward of an initiation line of closing. Enclosing portion 17, between rotors 13 and 14, is narrower closer to the root than it is further from the root at the time of the initiation of closing.

Referring to FIG. 15, in the above described embodiment, further rotation of the rotors after the initiation of the closing causes the closing line to reach the position represented by broken line "a". The path for relieving the liquid is part "b" which is represented by slanting lines. It is clear that only a small opening is available for relieving the liquid immediately after the initiation of closing.

Referring to FIG. 16, the release of liquid in the axial direction is impeded because of step portion 16*a* while the liquid is released unimpeded in the circumferential direction. Thus, the above conventional configuration is not capable of preventing liquid compression completely, Instead, it produces a pressure increase at the beginning of closing.

In order to completely eliminate liquid compression, it is necessary to cut a recess extending past the closing initiation line. This, however, results in an excessive leakage of the compressed gas. Furthermore, referring to FIGS. 17 and 18, at high peripheral velocity of the rotor, the liquid on the surface of the casing 12 flows in direction "d", which is the reverse of direction "c" in which the enclosed liquid tends to run off along the circumference. The opposing flows thus resist the relief of the liquid in the circumferential direction. Therefore, it is necessary to cut a recess that is larger than the closing initiation line to completely eliminate liquid compression.

OBJECTS AND SUMMARY OF THE INVENTION

It is an object of the present invention to provide a liquid injection type screw compressor which overcomes the drawbacks of the prior art.

It is a further object of the present invention is to provide a liquid injection type screw compressor that is capable of maintaining compression efficiency while preventing the occurrence of the liquid compression phenomenon.

Another object of the present invention is to provide a liquid injection type screw compressor that eliminates drastic increases in pressure caused by the liquid compression phenomenon by the relieving of pressure on the liquid during the discharge process.

Briefly stated, the present invention provides a liquid injection type screw compressor having a casing with an intake end and a discharge end, and a male rotor and female rotor engaging each other and rotatably mounted upon bearings in the casing. The male rotor has a radius R and Z-number of helical convex teeth, each of which is chamfered on a leading edge of an end facing the discharge end of the casing so as to allow lubricating liquid to escape from a space between rotor teeth during discharge stages of operation. Thus, drastic increases in pressure upon the bearings due to a liquid compression phenomenon are prevented while leakage of compressed gas from the discharge end to the intake end is minimized. Thrust forces produced by the liquid against a flat chamfer surface from a wedge effect prevent scoring of the edges of the rotors and thus permit designs with narrow gaps between the rotors and the casing to increase the efficiency of the compressor.

According to an embodiment of the invention, there is provided a liquid injection type screw compressor comprising: a casing having an intake port and a discharge port, rotor means for taking in a gas through the intake port, transporting it through spaces, and discharging the gas through the discharge port, means for providing a three sided passage between a first space compressing the gas to a second space intaking the gas so as to relieve pressure exerted upon the liquid by the rotor means while maintaining efficiency of the screw compressor.

Further, according to the present invention, the chamfer of the male rotor is formed by a single flat or curved surface.

In an embodiment of the present invention a closing initiation line generally corresponds to a chamfer edge, with no step being formed in any direction. The liquid pressure is relieved effectively due to the absence of a step, and leakage of compressed gas is held to a minimum.

According to an embodiment of the invention, there is provided a liquid injection type screw compressor comprising: a casing, a first end of said casing being an intake end, a second end of said casing being a discharge end, a male rotor in said casing, said male rotor and said female rotor being rotatable in engagement with each other, a discharge end on said male rotor, a discharge end on said female rotor, said male rotor having a number Z of helical teeth having convex profiles, said male rotor having an outer radius of R, said teeth of said male rotor each having a chamfered portion along a leading edge on said discharge end of the male rotor facing said discharge end of said casing, said chamfered portion beginning at a point P located in said leading edge at an angle $\phi_S$ from a tip of a tooth, said angle $\phi_S$ being in a first range defined by a first expression $$-10° \leqq \phi_S \leqq 35°$$

and having a rotation axis of said male rotor as a center and in a positive direction of rotation of said male rotor, said chamfered portion extending to and ending at a point Q located on said leading edge at an angle $\phi_E$, said angle $\phi_E$ being in a second range defined by a second expression:

$$\phi_S < \phi_E \leqq 160°/Z,$$

said chamfered portion extending a distance $D_r$ in a radial direction of said male rotor and a distance $D_S$ in an axial direction of said male rotor, and said distances $D_r$ and $D_S$ being respectively defined by ranges of the following expressions:

$$0.007R \leqq D_r \leqq (1.2/Z)R, \text{ and}$$

$$0.007R \leqq D_S \leqq (1.2/Z)R.$$

According to a feature of the invention, there is provided a liquid injection type screw compressor comprising: a casing having an intake port and a discharge port, rotor means for taking in a gas through said intake port, transporting it through spaces, and discharging said gas through said discharge port, means for providing a three sided passage between a first space compressing said gas to a second space intaking said gas, and said three sided passage including means for relieving pressure exerted upon said liquid by said rotor means while maintaining efficiency of said screw compressor.

The above, and other objects, features and advantages of the present invention will become apparent from the following description read in conjunction with the accompanying drawings, in which like reference numerals designate the same elements.

DETAILED DESCRIPTION OF PREFERRED EMBODIMENTS

Figure 1:
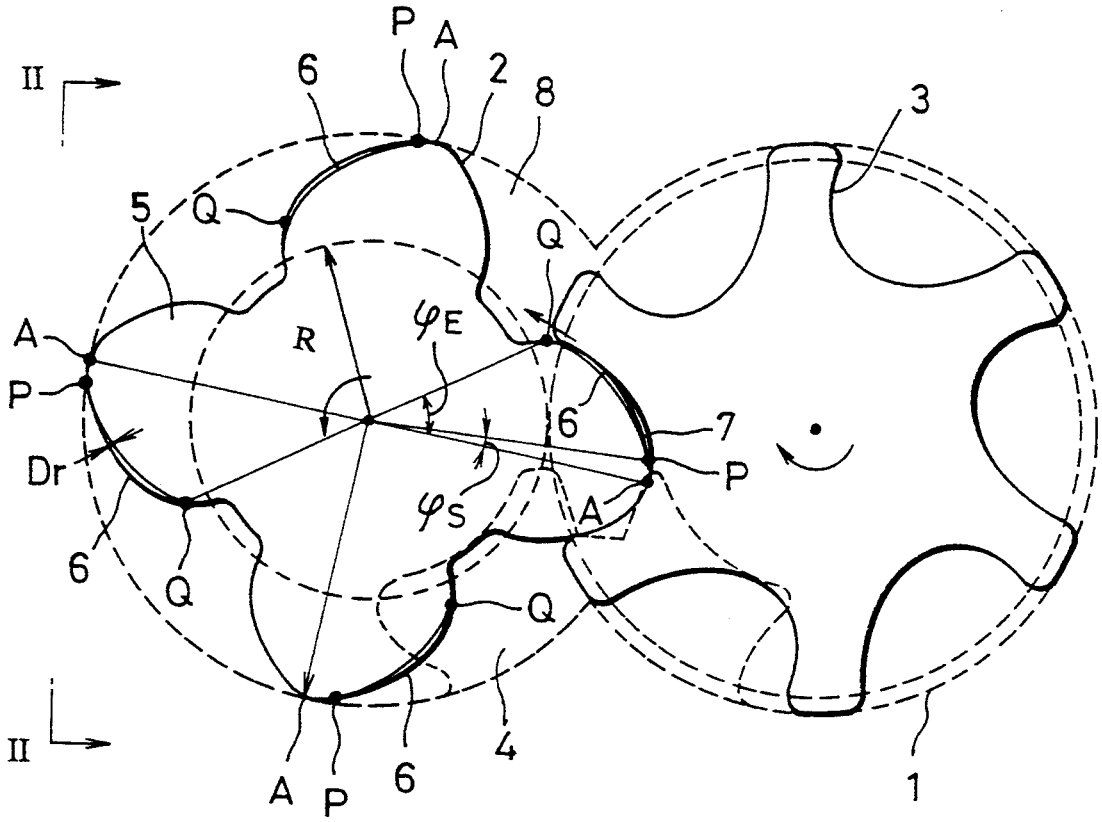
FIG. 1 is a radial or plan view of a discharge end of a casing of a preferred embodiment of a liquid injection type screw compressor according to an embodiment of the present invention.

Referring to FIG. 1, a casing 1 encloses a male rotor 2 and a female rotor 3, each having helical teeth in engagement with each other. Male rotor 2 and female rotor 3 are rotatably mounted parallel to each other upon bearings at both ends of casing 1. A first end of casing 1 includes an intake port and thus serves as the intake end. A second end of casing 1 includes a discharge port 4, thus serving as a discharge end.

The male rotor 2 has an outer radius R and Z-number of teeth with convex profiles. Each tooth has an end 5 facing the discharge end of casing 1. The end 5 has a chamfer 6 formed upon it.

Figure 3:
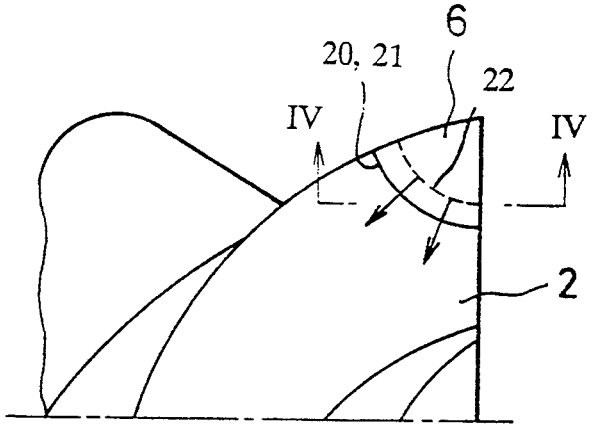
FIG. 3 is a plan view of a part of the discharge end of the male rotor of the screw compressor of the present invention. The arrows show the direction of compression of the gas and liquid after closing is initiated.
Figure 4:
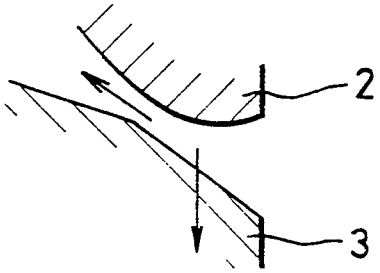
FIG. 4 is a sectional view cut along the line IV—IV of the portion of the male rotor shown in FIG. 3.

Referring to FIGS. 3 and 4, chamfer 6 has a curved surface in which a distance between an intersection of a chamfer surface of chamfer 6 with the tooth surface of male rotor 2 and the end 5 does not exceed 400/R.

A chamfer line 21 corresponds to lien 20 of chamfers where closing is initiated. A line 22 is the closing line where gas and liquid are compressed after closing is initiated.

Referring back to FIG. 1, chamfer 6 extends along an edge of the end 5 through a range from point P to point Q. Point P represents a point on the end 5 of male rotor 2 past where contact is made with female rotor 3 during the fully closed condition. The positions of points P and Q are defined by angles about the center axis of male rotor 2, having end point A on a tip of each tooth of male rotor 2 as a starting point. The arcs of the angles extend in the direction of rotation of male rotor 2 (represented by an arrow in FIG. 1) to points P and Q.

The starting point of the chamfer 6, point P, is displaced from point A by an angle $\phi_S$, where $\phi_S$ is defined as follows:

$$-10° \leqq \phi_S \leqq 35° \quad (1).$$

The end point of chamber 6, point Q is displaced from point A by an angle $\phi_E$, where $_E$ is defined as follows:

$$\phi_S < \phi_E \leqq 160°/Z \quad (2)$$

Figure 2:
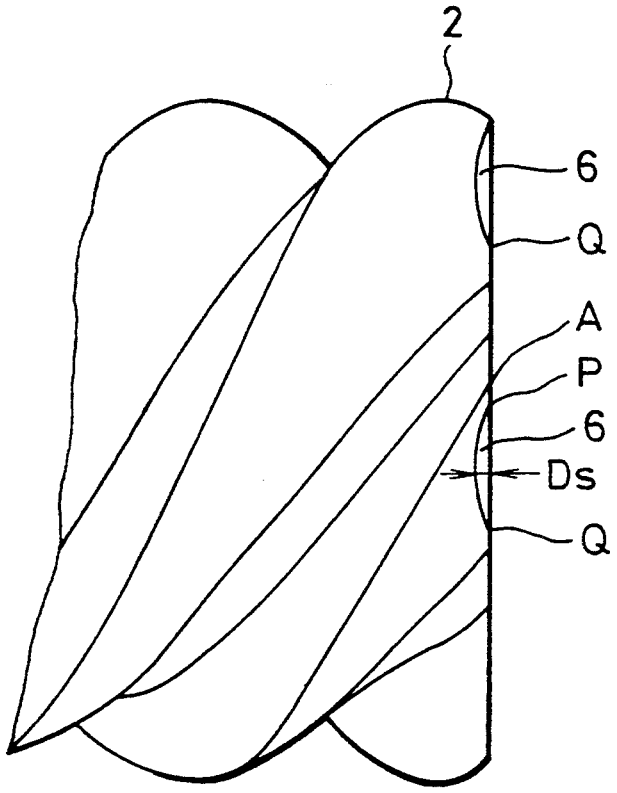
FIG. 2 is a side or axial view of a part of the discharge end of a male rotor of the screw compressor of the present invention as shown from II—II of FIG. 1.

Referring to FIGS. 1 and 2, chamfer 6 extends a distance $D_r$ in the radial direction of male rotor 2 and a distance $D_S$ in the axial direction of male rotor 2. Ranges for the distances $D_r$ and $D_S$ are defined by the following formulas:

$$0.007R \leqq D_r \leqq (1.2/Z)R \quad (3)$$

$$0.007R \leqq D_S \leqq (1.2/Z)R \quad (4)$$

The shape of chamfer 6 may be of any appropriate shape including a fiat surface and a curved concave arc-shaped surface extending from point P to point Q along the edge part.

Female rotor 3 has concave teeth rotating in contact with male rotor 2 in the vicinity of a pitch circle.

In the above embodiment, liquid, such as cooling oil, is injected into casing 1 to lubricate the surfaces of teeth of male and female rotors 2 and 3. Additionally, the liquid functions as a seal between male and female rotors 2 and 3 and the casing 1 so that leakage of compressed gas from the discharge end to the intake end is minimized.

During operation of the present invention gas is drawn through the intake port of casing 1 into rotor tooth space 7. Rotor tooth space 7 is enclosed by rotors 2 and 3, and casing 1. As the rotors rotate, the rotor tooth space 7 is reduced and the gas therein is compressed and discharged through discharge port 4 of casing 1.

The liquid enclosed in rotor tooth space 7 has pressure exerted upon it from a decrease in a volume of rotor tooth space 7 during the discharge process. This pressure is applied during the stages of the discharge process during which the "semi-closed condition" and the "completely closed condition" occur. During the "the semi-closed condition", a radial exhaust path for the compressed gas is closed by the teeth of rotors 2 and 3 so that the compressed gas is discharged from rotor tooth space 7 only in the axial direction. During the "completely closed condition" there is no path to connect rotor tooth space 7 to discharge port 4.

Pressure exerted upon the liquid during the above stages is relieved via a passage between rotor tooth space 7 and a rotor tooth space 8 created by chamfer 6 and casing 1. During these stages, rotor tooth space 8 is in the intake process. The liquid is forced into rotor tooth space 8 eliminating the drastic rise of pressure due to the liquid compression phenomenon. Thus, bearings of rotors 2 and 3 are protected from exposure to loads generated by pressure being applied to the liquid during the liquid compression phenomenon and the life span of the bearings is thereby extended.

If the dimensions $D_r$ in the radial direction and $D_S$ in the axial direction are less than 0.007R, the minimum value designated in formulas (3) and (4), pressure relief during the liquid compression phenomenon is ineffective even when chamfer 6 of male rotor 2 is within the range defined by formulas (1) and (2). If the dimensions $D_r$ and $D_S$ exceed (1.2/Z)R, the maximum value designated in formulas (3) and (4), a substantial amount of compressed gas leaks from the discharge end of casing 1 to the intake end, thereby reducing compression efficiency.

Therefore, if male rotor 2 has four teeth and an outer radius of 102 mm, and the range of chamfering of male rotor 2 extends from points P to Q defined by $\phi_S=5°$ to $\phi_E=35°$ in accordance with formulas (1) and (2), the chamfered amount $D_r$ in the radial direction is 4 mm in accordance with formula (3), and chamfered amount $D_S$ in the axial direction is 4 mm in accordance with formula (4). With the male rotor 2 rotating at 4000 rpm, it is possible to prevent a radical pressure rise of the liquid due to the liquid compression phenomenon during the discharge process without causing leakage of compressed gas from the discharge end to the intake end. As a result, the compression efficiency is improved by 3%, because the driving force which, in the prior art, was consumed by compression of the liquid, is reduced.

Figure 5:
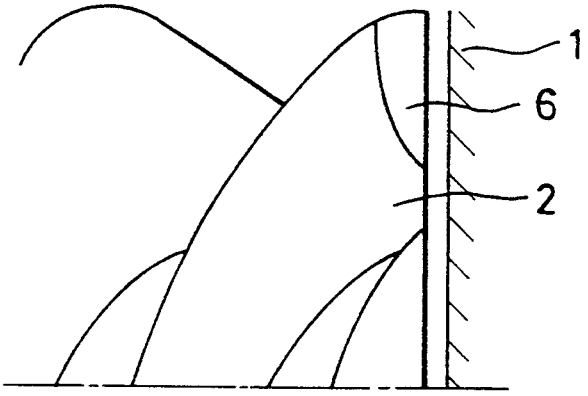
FIG. 5 is a plan view of a part of the male rotor with a flat chamfer.

Referring to FIGS. 3, 4 and 5, an embodiment of the present invention has chamfer 6 formed by cutting a corner of male rotor 2 along closing initiation line 20. The chamfering line 21 thus corresponds to the closing initiation line 20 and the chamfer 6 creates a large path for run-off after the initiation of closing with no step formed in any direction. Therefore there is no leakage through chamfer 6 before the initiation of closing. The pressure due to compression of the liquid are significantly reduced in comparison to those of a configuration having a narrow path and a large step on a surface of a tooth of male rotor 2.

Figure 6:
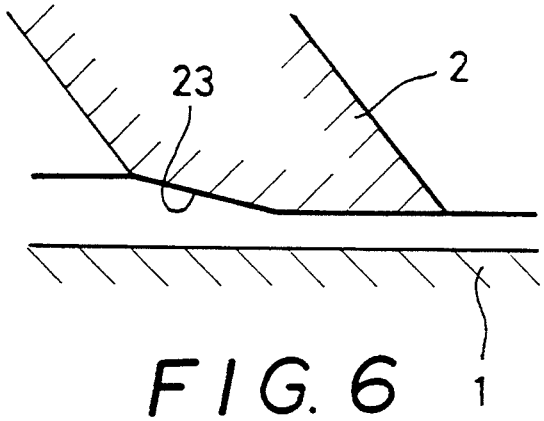
FIG. 6 is a fragmentary side or axial view of a portion of the male rotor.
Figure 7:
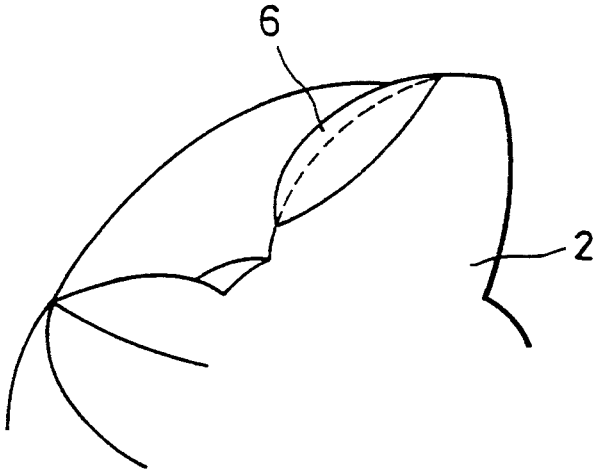
FIG. 7 is a fragmentary oblique view of a portion of the male rotor.

Referring to FIGS. 5 through 7, chamfer 6 is formed by a flat surface cutting through an edge of the discharge end of male rotor 2. A chamfered surface 23 is tapered in the direction of rotation as shown in FIG. 6 to define a wedge shaped space between male rotor 2 and casing 1.

The effect of the wedge shaped space upon the liquid lubrication generates a thrust force on chamfered surface 23 in the axial direction so that the end of male rotor 2 is prevented from contacting casing 1. The thrust force increases when the space between the end of male rotor 2 and an inner surface of casing 1 is reduced. This thrust force prevents the discharge end surfaces of rotors 2 and 3 and the inside surface of the casing 1 from becoming scored during operation, even if the space therebetween is narrow.

The space between the discharge ends of rotors 2 and 3 and the inner surface of casing 1 affects the performance of the compressor and is therefore an important factor in the design of a screw compressor. Reducing this space reduces the amount of gas leakage therethrough and consequently improves the efficiency of the compressor.

The chamfering of the discharge end of rotor 2, shown in FIG. 5, permits the space between the discharge ends of rotors 2 and 3 and the inner surface of the casing 1 to be reduced and the efficiency of the screw compressor to be increased. The thrust force upon tapered chamfered surface 23, formed on a leading edge of the rotor, prevents scoring, thereby allowing a narrower space to be used in the design of the compressor.

Figure 8:
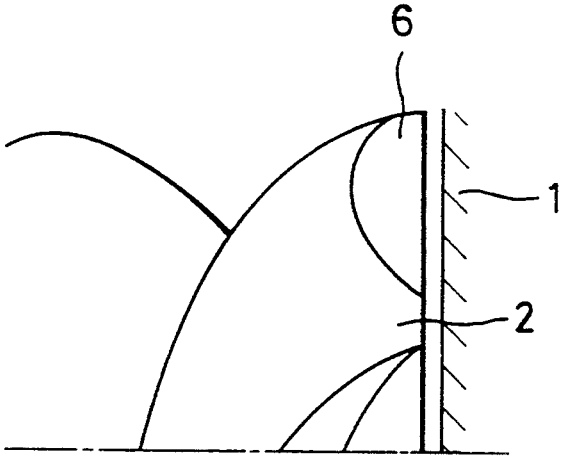
FIG. 8 is a plan view of a part of the male rotor with a curved chamfer.
Figure 9:
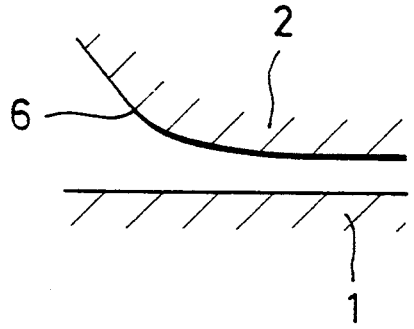
FIG. 9 is a side view of the male rotor with a curved chamfer.
Figure 10:
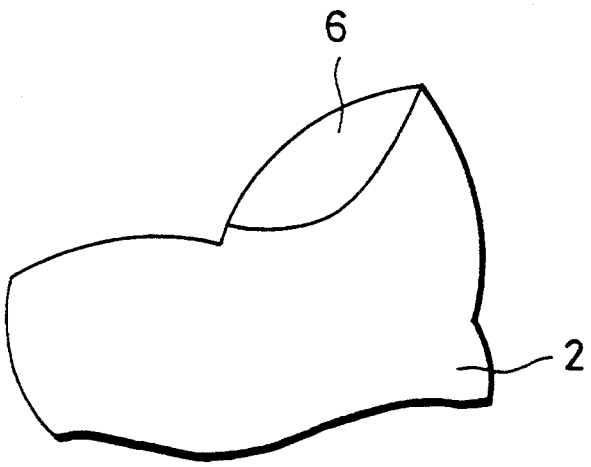
FIG. 10 is an oblique view of the male rotor with a curved chamfer.
Figure 11:
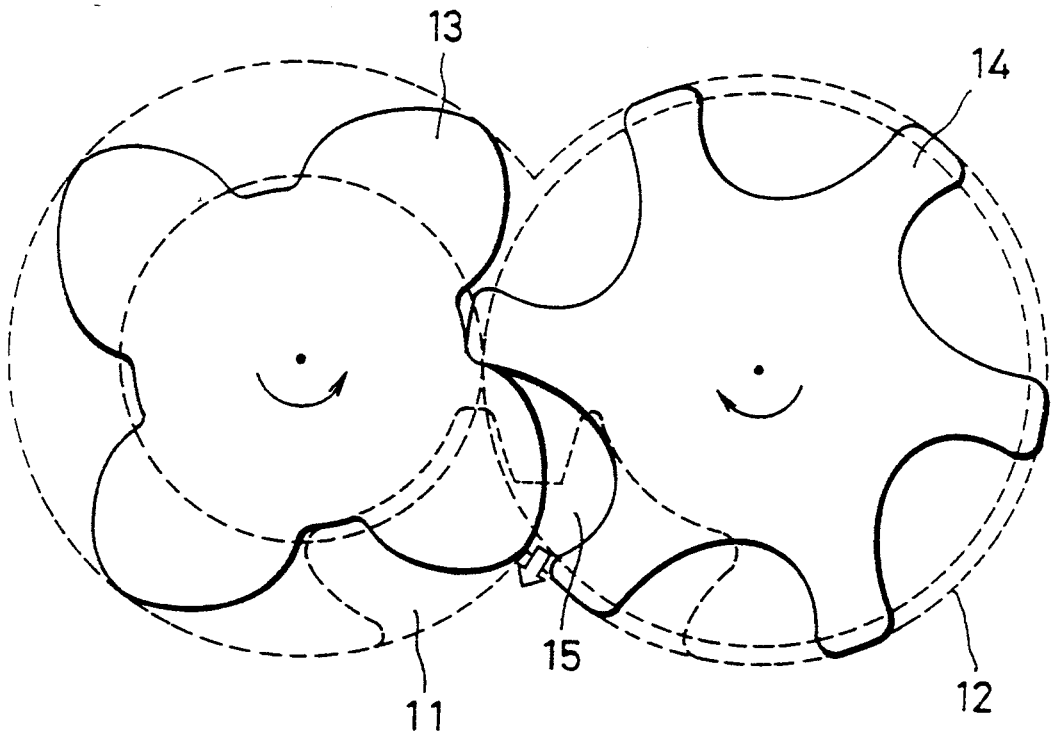
FIG. 11 PRIOR ART
FIG. 11 is a front view showing a conventional liquid injection type screw compressor under a condition where a direction of a discharge of compressed gas from the rotor tooth space corresponds to a radial direction and an axial direction of a rotor tooth space.
Figure 12:
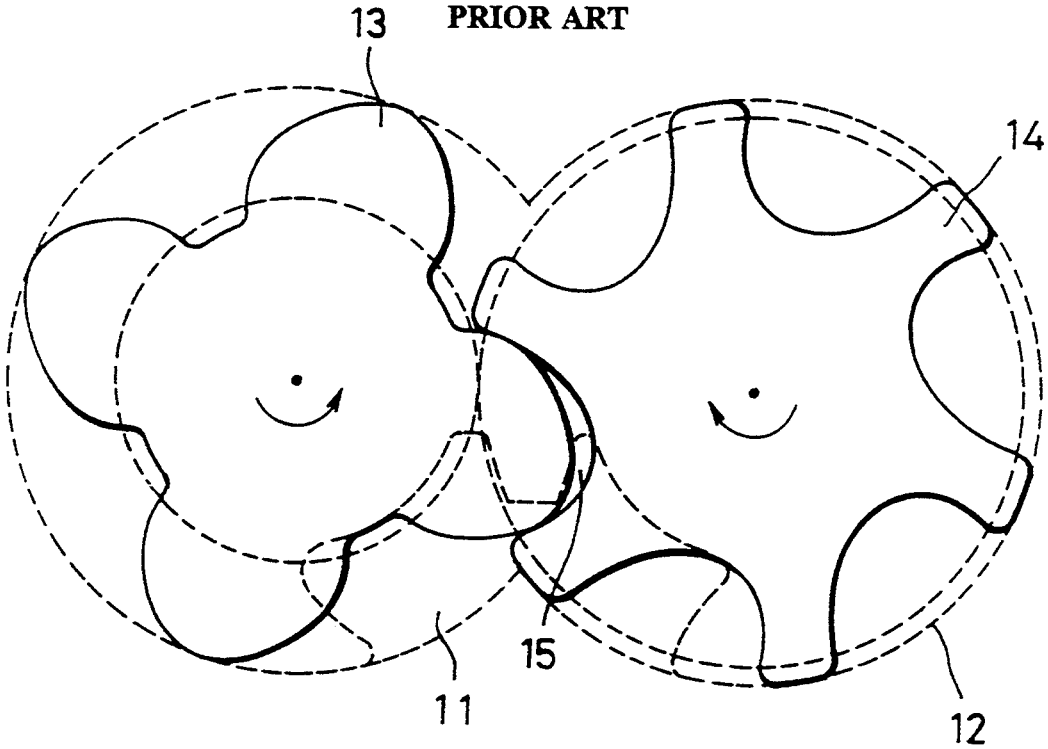
FIG. 12 PRIOR ART
FIG. 12 is a front view showing the same conventional liquid injection type screw compressor as shown in FIG. 11 wherein a direction of a discharge of compressed gas from the rotor tooth space corresponds solely to the axial direction of this rotor tooth space.
Figure 13:
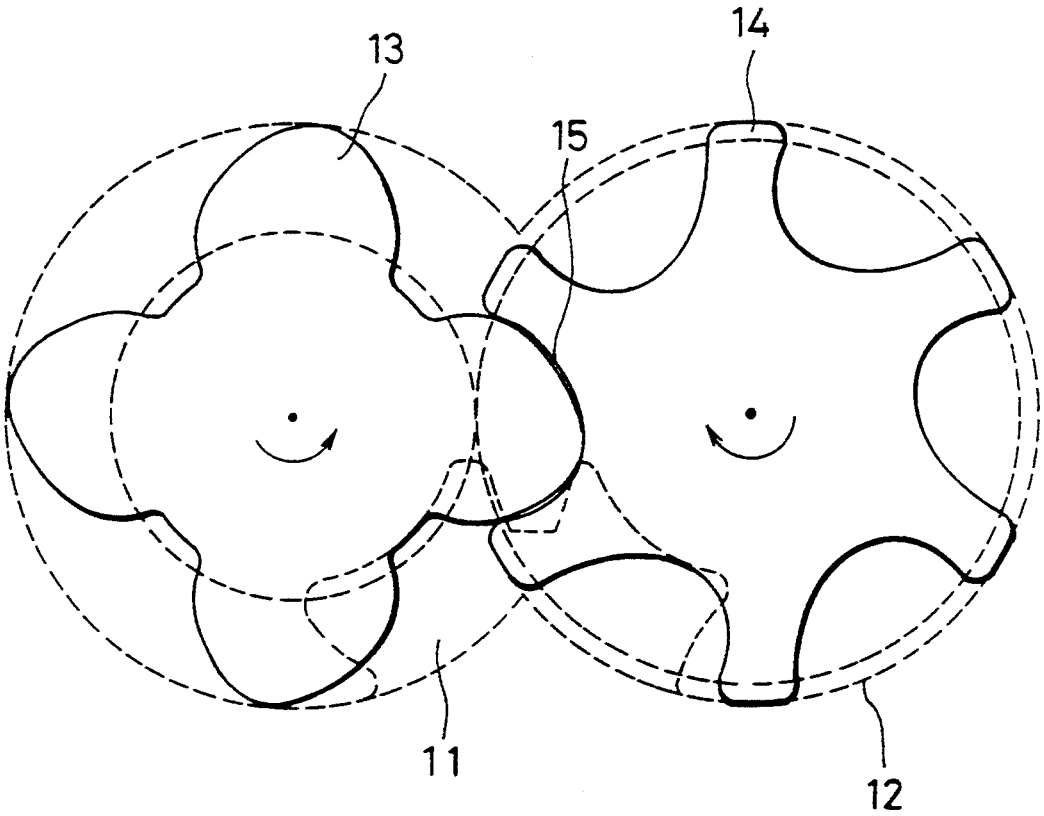
FIG. 13 PRIOR ART
FIG. 13 is a front view showing the same conventional liquid injection type screw compressor as shown in FIG. 11 wherein discharge path connecting the said rotor tooth space to a discharge port is closed.
Figure 14:
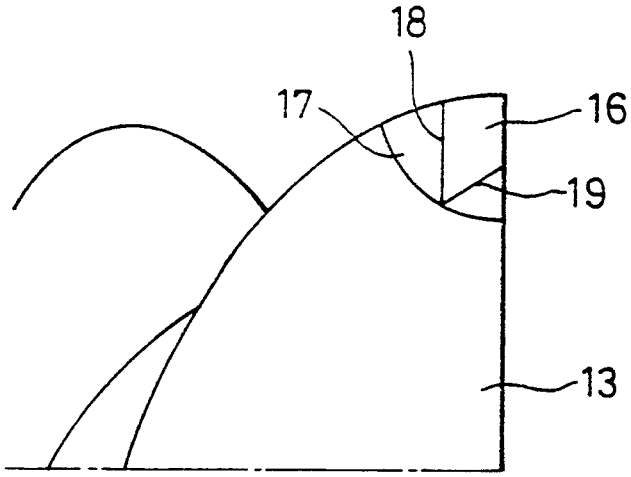
FIG. 14 PRIOR ART
FIG. 14 is a side view of a part a male rotor wherein the discharge end thereof is cut off.
Figure 15:
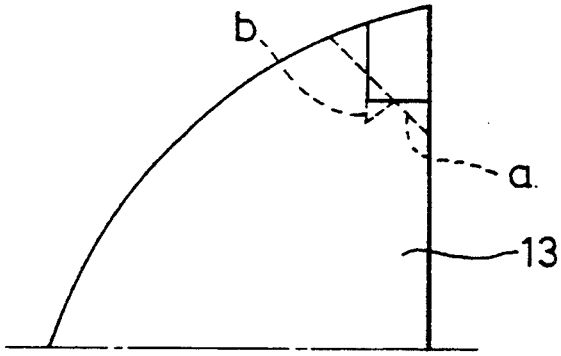
FIG. 15 PRIOR ART
FIG. 15 is a side view of the male rotor of FIG. 14 when further rotated.
Figure 16:
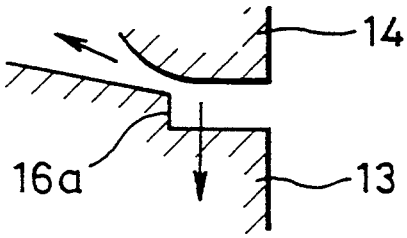
FIG. 16 PRIOR ART
FIG. 16 is a sectional view of a portion of the male rotor shown in FIG. 15.
Figure 17:
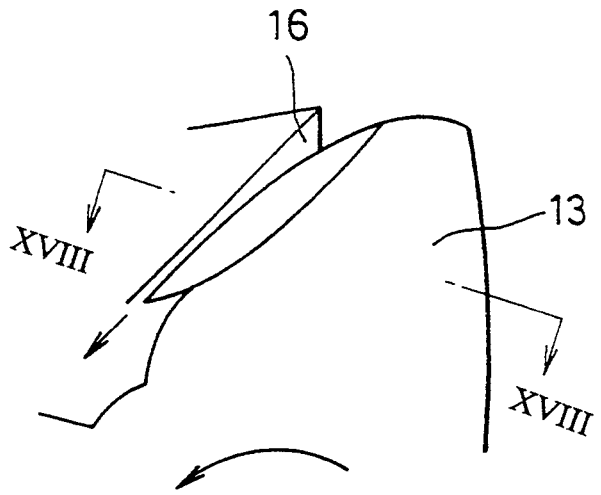
FIG.17 PRIOR ART
FIG. 17 is a fragmentary oblique view of the male rotor shown in FIG. 15.
Figure 18:
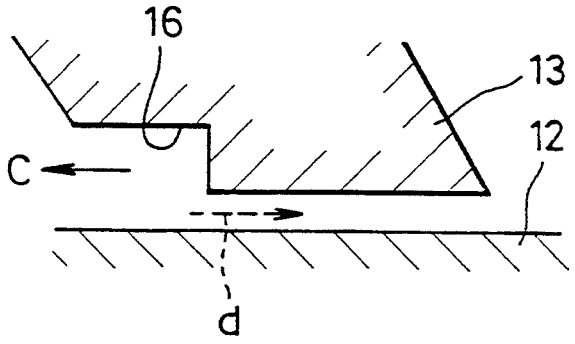
FIG.18 PRIOR ART
FIG. 18 is a fragmentary side or axial view along line XVIII—XVIII of a portion of the male rotor shown in FIG. 17.

Referring to FIGS. 8 through 10, chamfer 6 at the discharge end of male rotor 2 has a curved surface. The curved surface makes it possible to increase the range where the space between rotors 2 and 3 and the inner surface of casing 1 is small, thereby increasing the wedge effect. Furthermore, even though the space between rotors 2 and 3 is considerably reduced, abrasion between their facing surfaces is prevented. Thus, the efficiency of the compressor is improved.

Unlike the force exerted by the liquid compression phenomenon, the thrust force generated by the wedge effect is not a pulsed force and has little effect on the bearings or the seal. Therefore, the thrust force can be effectively used to increase the efficiency of the screw compressor.

A liquid injection type screw compressor according to the present invention may be used in a variety of applications requiring compression of gas and is particularly effective in freezing device applications.

What is claimed is:

1. A liquid injection screw compressor comprising
a casing having an intake port and a discharge port;
rotor means in said casing for taking in a gas through said intake port, transporting said gas through spaces, and discharging said gas through said discharge port;
means defining a three sided passage between a first space compressing said gas and a second space receiving said gas; and
said three sided passage including means for relieving pressure exerted upon a liquid by said rotor means while maintaining efficiency of said screw compressor.

2. A liquid injection screw compressor of claim 1 wherein said means defining the three sided passage comprises:
said rotor means including a first rotor having a leading edge at a discharge end thereof;
a second rotor rotating in engagement with said first rotor; and
said leading edge having a chamfer thereon so as to produce the three sided passage having a chamfer surface, an inside surface of said casing, and the second rotor as sides of the three sided passage.

3. A liquid injection screw compressor of claim 2 wherein said chamfer is a flat surface.

4. A liquid injection screw compressor of claim 2 wherein said chamfer is a curved surface.

5. A liquid injection screw compressor comprising:
a casing;
a first end of said casing being an intake end;
a second end of said casing being a discharge end;
a male rotor and a female rotor in said casing;
said male rotor and said female rotor being rotatable in engagement with each other;
a discharge end on said male rotor;
a discharge end on said female rotor;
said male rotor having a number Z of helical teeth having convex profiles;
said male rotor having an outer radius of R;
said teeth of said male rotor each having a chamfered portion along a leading edge on said discharge end of the male rotor facing said discharge end of said casing;

said chamfered portion beginning at a point P located in said leading edge at angle $\phi_S$ from a tip of each of said teeth;

said angle $\phi_S$ being in a first range defined by a first expression $$-10° \leqq \phi_S \leqq 35°$$

and having a rotation axis of said male rotor as a center and in a positive direction of rotation of said male rotor;

said chamfered portion extending to and ending at a point Q located on said leading edge at an angle $\phi_E$;

said angle $\phi_E$ being in a second range defined by a second expression $$\phi_S \phi_E \leqq 160°/Z;$$

said chamfered portion extending a distance $D_r$ in a radial direction of said male rotor and a distance $D_S$ in an axial direction of said male rotor; and said distances $D_r$ and $D_S$ being respectively defined by ranges of the following expressions:

$$0.007R \leqq D_r \leqq (1.2/Z)R; \text{ and}$$

$$0.007R \leqq D_S \leqq (1.2/Z)R$$

6. A liquid injection screw compressor of claim 1 wherein said chamfer is formed of a single surface.

7. A liquid injection screw compressor of claim 6 above wherein said single surface is a flat surface.

8. A liquid injection screw compressor of claim 6 above wherein said single surface is a curved surface.

9. A liquid injection screw compressor comprising:

a casing having an intake port and a discharge port;

rotor means in said casing for taking in a gas through said intake port, transporting said gas through spaces, and discharging said gas through said discharge port;

means defining a three-sided passage between a first space compressing said gas and a second space receiving said compressed gas;

said three-sided passage including means for relieving pressure exerted upon said liquid by said rotor means while maintaining efficiency of said screw compressor;

said means defining said three-sided passage further comprising:

said rotor means including a first rotor having a leading edge at a discharge end thereof;

a second rotor rotating in engagement with said first rotor; and said leading edge having a chamfer thereon so as to produce a three sided passage having a chamfer surface, an inside surface of said casing, and said second rotor as sides of the three sided passage;

said chamfer beginning at a point P located in said leading edge at an angle $\phi_S$ from a tip of said rotor;

said angle $\phi_S$ being in a first range defined by a first expression $$-10° \leqq \phi_S \leqq 35°$$

and having a rotation axis of said rotor as a center and with a rotation direction of the rotor being in a positive direction;

said chamfer extending to and ending at point Q located on said leading edge at a an angle $\phi_E$;

said angle $\phi_E$ being in a second range defined by a second expression $$\phi_S < \phi_E \leqq 160°/Z;$$

said chamfer extending a distance $D_r$ in a radial direction of said rotor and a distance $D_S$ in an axial direction of said rotor; and said distances $D_r$ and $D_S$ being respectively defined by ranges of the following expressions:

$$0.007R \leqq D_r \leqq (1.2/Z)R; \text{ and}$$

$$0.007R \leqq D_S \leqq (1.2/Z)R.$$

10. A liquid injection screw compressor of claim 9 wherein said chamfer is a flat surface.

11. A liquid injection screw compressor of claim 9 wherein said chamfer is a curved surface.

* * * * *

UNITED STATES PATENT AND TRADEMARK OFFICE

CERTIFICATE OF CORRECTION

PATENT NO. : 5,350,286

DATED : September 27, 1994

INVENTOR(S) : Takayuki Kisi, et al.

It is certified that error appears in the above-indentified patent and that said Letters Patent is hereby corrected as shown below:

On title page, item [73] Assignee, should read as follows:

--Kabushiki Kaisha Maekawa Seisakusho--.

Signed and Sealed this

Sixth Day of December, 1994

Bruce Lehman

*Attest:*

BRUCE LEHMAN

*Attesting Officer*

*Commissioner of Patents and Trademarks*